US012213563B2

(12) United States Patent
Ibarra et al.

(10) Patent No.: US 12,213,563 B2
(45) Date of Patent: Feb. 4, 2025

(54) ICE CRAMPON

(71) Applicant: BLUE ICE EUROPE, Les Houches (FR)

(72) Inventors: Juan-Manuel Ibarra, Crest (FR); Paul Oddou, Oceanside, CA (US)

(73) Assignee: BLUE ICE EUROPE, Les Houches (FR)

( * ) Notice: Subject to any disclaimer, the term of this patent is extended or adjusted under 35 U.S.C. 154(b) by 29 days.

(21) Appl. No.: 17/998,272

(22) PCT Filed: May 3, 2021

(86) PCT No.: PCT/FR2021/050761
§ 371 (c)(1),
(2) Date: Nov. 9, 2022

(87) PCT Pub. No.: WO2021/234237
PCT Pub. Date: Nov. 25, 2021

(65) Prior Publication Data

US 2023/0210222 A1 Jul. 6, 2023

(30) Foreign Application Priority Data

May 19, 2020 (FR) ..... 20/05023

(51) Int. Cl.
*A43C 15/06* (2006.01)

(52) U.S. Cl.
CPC ..... *A43C 15/063* (2013.01); *A43C 15/066* (2013.01)

(58) Field of Classification Search
CPC ..... A43C 15/063; A43C 15/066
See application file for complete search history.

(56) References Cited

U.S. PATENT DOCUMENTS 3,786,579 A 1/1974 Clark
4,344,238 A * 8/1982 Peyser ..... A43C 15/068 36/62

(Continued)

FOREIGN PATENT DOCUMENTS

AT 360406 B 1/1980
DE 3418832 A1 11/1985

(Continued)

OTHER PUBLICATIONS

English Translation of DE102016212445 (Year: 2018).*

(Continued)

*Primary Examiner* — Ted Kavanaugh
(74) *Attorney, Agent, or Firm* — CANTOR COLBURN LLP

(57) ABSTRACT

An ice crampon designed to be attached to a footwear item includes a front portion which has at least one pair of front tips a rear portion which has at least one pair of rear tips; at least one flexible link which connects the front portion and the rear portion to each other; and at least one intermediate portion which is mounted on the flexible link by being positioned between the front portion and the rear portion. The at least one intermediate portion has at least one pair of intermediate tips. The pairs of front tips, rear tips, and intermediate tips are configured to prevent the ice crampon from sliding on ground, particularly on frozen ground. The front portion, the rear portion, and the intermediate portion are articulated independently of each other, and the position of the intermediate portion are adjustable in relation to the flexible link.

15 Claims, 2 Drawing Sheets

(56) References Cited

U.S. PATENT DOCUMENTS

| | | | | |
|---|---|---|---|---|
| 4,461,104 | A * | 7/1984 | Calkin | A43B 5/0419 12/120.5 |
| 2004/0016145 | A1* | 1/2004 | Skrivan | A43C 15/068 36/7.6 |
| 2015/0216265 | A1* | 8/2015 | Bonnet | A43C 15/066 36/64 |

FOREIGN PATENT DOCUMENTS

| | | | | |
|---|---|---|---|---|
| DE | 3803755 | A1 | 9/1988 | |
| DE | 102016212445 | A1 * | 1/2018 | |
| DE | 102018201225 | A1 * | 8/2019 | A43B 5/00 |
| EP | 0300244 | A2 * | 1/1989 | |
| ES | 1142237 | U * | 8/2015 | |
| RU | 185753 | U1 * | 12/2018 | |

OTHER PUBLICATIONS

English Translation of DE102018201225 (Year: 2018).*
English Translation of EP0300244 (Year: 1989).*
English Translation of ES 1142237 (Year: 2015).*
English Translation of RU 185753 (Year: 2018).*
International Search Report issued Aug. 12, 2021 re: Application No. PCT/FR2021/050761, pp. 1-2, citing: DE 3803755 A1, DE 3418832 A1, AT 360406 B, U.S. Pat. No. 3,786,579 A and DE 102016212445 A1.

* cited by examiner

ICE CRAMPON

TECHNICAL FIELD

The present disclosure concerns a crampon intended to prevent the user from slipping when the crampon is used in mountaineering on snow and ice or in climbing on mixed terrain.

BACKGROUND

In practicing mountain sports, such as mountaineering and in particular trekking on ice or climbing ice falls, it is necessary to fasten a crampon to the boot so as to prevent the user from slipping.

It is known from the state of the art to use an ice crampon of the aforementioned type, said crampon being provided with spikes to prevent slipping. In general, the spikes are distributed under the entire foot from the front of the crampon to the back of the crampon. In general, the crampon is composed of a front part and a rear part.

Some state-of-art solutions propose a crampon with a longer front part to allow more spikes to be disposed under the boot. Another method described in the document DE7529410U consists in proposing an ice crampon having more than two structural parts, in particular an intermediate part provided with spikes. These solutions are satisfactory since they enable a better grip of the boot equipped with the crampon on ice.

However, the increase in the dimensions of the front part, or the addition of an intermediate part contributes to increasing the mass of the ice crampon and reduces the ergonomics and the compactness of the entire crampon when it is not mounted on the boot, for example when it is stored or transported.

SUMMARY

The present disclosure proposes a solution which addresses all or part of the aforementioned problems.

In particular, the present disclosure aims to meet at least one of the following advantages:

proposing a good grip on an icy ground;

being light;

having a small bulk by a high compactness;

having an ease of storage.

This aim can be achieved thanks to the implementation of an ice crampon intended to be fastened to a boot, the ice crampon comprising:

a front part comprising at least one pair of front spikes offset from each other along a lateral direction of the front part;

a rear part comprising at least one pair of rear spikes offset from each other along a lateral direction of the rear part;

at least one flexible link which connects the front part and the rear part to each other along a longitudinal direction of the ice crampon;

at least one intermediate part mounted on the flexible link by being positioned between the front part and the rear part, the at least one intermediate part comprising at least one pair of intermediate spikes offset from each other along a lateral direction of the intermediate part;

said at least one pair of front spikes, the pair of rear spikes and said at least one pair of intermediate spikes being configured to prevent slipping of the ice crampon on a ground and in particular an icy ground;

the front part, the rear part and said at least one intermediate part being hinged independently of each other at least along the longitudinal direction and along said lateral directions, and the position of the intermediate part being adjustable relative to the flexible link along the longitudinal direction.

The previously described arrangements and in particular the presence of the flexible link, allow individually hinging the front part, the rear part and the at least one intermediate part. In this way, the ice crampon can be adapted to different boot sizes. Furthermore, the adjustment of the intermediate part by means of the at least one flexible link allows, for example, placing said intermediate part in abutment on the front part or on the rear part, and freezing its position once the ice crampon is tensioned on the boot. In this way, the position of the intermediate part can be longitudinally adjusted on the flexible link so as to be adapted to the terrain or to the user's practice.

The ice crampon may further have one or more of the following features, taken alone or in combination.

According to one embodiment, the at least one flexible link is configured to allow the intermediate part to be positioned in abutment on the front part, or on the rear part. In this way, it is possible to improve the comfort of the user when climbing.

According to one embodiment, the at least one flexible link is configured to enable a continuous adjustment of the position of the intermediate part relative to the flexible link over the entire length of the flexible link. Thus, it is possible to carry out a fine adjustment of the intermediate part over the length of the flexible link.

According to one embodiment, the adjustment of the intermediate part on the flexible link is carried out by friction. In this way, it is possible to adjust the position of the intermediate part during use of the ice crampon in a simple way by sliding the intermediate part over the length of the flexible link. Thus, the adjustment of the position of the intermediate part can be carried out quickly without requiring special tools, like a screwdriver.

According to one embodiment, the at least one flexible link is configured to enable a continuous adjustment of the position of the rear part relative to the flexible link over the entire length of the flexible link. Thus, it is possible to carry out a fine adjustment of the rear part over the length of the flexible link.

According to one embodiment, the adjustment of the rear part on the flexible link is carried out by friction. In this way, it is possible to adjust the position of the rear part during use of the ice crampon in a simple way by sliding the rear part over the length of the flexible link. Thus, the adjustment of the position of the rear part can be carried out quickly without requiring special tools, like a screwdriver.

According to one embodiment, the at least one flexible link is made in one-piece extending integrally between the front part and the rear part.

According to one embodiment, the front part comprises a front connecting element, configured to connect the front part with said at least one flexible link, and wherein the rear part comprises a rear connecting element, configured to connect the rear part with said at least one flexible link, the intermediate part being configured to be detachable from the flexible link at the rear connecting element or the front connecting element.

In this way, it is possible to completely remove the intermediate part from the ice crampon, for example to increase the compactness and the lightness of the ice crampon to be adapted to the user's practice of the ice crampon.

According to one embodiment, said at least one flexible link is configured to be length-adjustable so as to adjust the distance separating the rear part from the front part. Advantageously, the rear connecting element and the front connecting element can enable a length adjustment of said at least one flexible link. The previously described arrangements allow proposing an ice crampon for which the length adjustment system is incorporated into the ice crampon. Furthermore, the length adjustment is continuous along the flexible link, so as to superfinely adjust the length.

According to one embodiment, the front connecting element comprises a front notch, on which the at least one flexible link is inserted, the at least one flexible link having a width smaller than the lateral dimension of the front notch, along the lateral direction of the front part.

According to one embodiment, the rear connecting element comprises a rear notch on which the at least one flexible link is inserted, the at least one flexible link having a width smaller than the lateral dimension of the rear notch along the lateral direction of the rear part.

According to one embodiment, the ice crampon comprises a single flexible link, which has a width sufficient to ensure the stability of the ice crampon so that the front, intermediate and rear parts remain substantially parallel to each other. For example, the width of the flexible link is greater than 3 cm counted perpendicular to the longitudinal direction of the ice crampon.

Advantageously, the use of a flexible link with a large width can improve the lateral hold of the ice crampon. In addition, the combination of a wide flexible link with a rear part, an intermediate part, and a front part having small dimensions allows guaranteeing a good stability of the boot on the ground and proposing an ice crampon with limited bulk and low weight.

Furthermore, a wide flexible link can facilitate the adjustment of the position of the intermediate part along the flexible link and the adjustment of the dimension of the front part and the rear part.

By "wide" it should be understood a width of the flexible link greater than one third of the width of the at least one intermediate part counted in the lateral direction of the at least one intermediate part.

According to one embodiment, the at least one flexible link undergoes a longitudinal tension when the ice crampon is fastened to the boot.

For example, the longitudinal tension is greater than 40 N, and more particularly greater than 50 N, and in particular substantially equal to 60 N.

According to one embodiment, the material of the at least one flexible link has a rigidity such that the elongation of the flexible link is smaller than 15% when the ice crampon is longitudinally tensioned.

For example, the material of the at least one flexible link can comprise ultra-high molar mass polyethylene, and/or high tenacity polyester, guaranteeing an elongation smaller than 3%.

According to this embodiment, the longitudinal tension undergone by the flexible link between the front part and the rear part ensures a friction locking of the longitudinal position of the intermediate part along the flexible link.

According to one embodiment, the ice crampon comprises two lateral flexible links.

The previously described arrangements allow providing a lateral stability of the boot on the ice crampon, in particular by avoiding the relative rotation of the front part, of the rear part and of the intermediate part, in particular when the ice crampon is longitudinally tensioned. In other words, the previously described arrangements allow suppressing a lateral pivoting of the ice crampon.

According to one embodiment, each flexible link can be selected from: a piece of cable, a piece of strap, a piece of cord.

According to one embodiment, the front part, the rear part and the at least one intermediate part are configured to nest with each other when they are superimposed relative to each other in a transverse direction of the ice crampon.

According to one embodiment, the at least one flexible link is configured to allow the ice crampon to vary between a deployed configuration in which the ice crampon is able to be fastened to the boot, and a nested configuration in which the front part, the rear part and the at least one intermediate part are nested with each other. It is therefore well understood that the flexibility of the flexible link allows the ice crampon to fold over itself, in particular to be stored when it is in the nested configuration.

According to one embodiment, the ice crampon remains intact when it varies between the deployed configuration and the nested configuration. It is therefore well understood that it is not necessary to dismantle the ice crampon so that it occupies the nested configuration.

According to one embodiment, the front part, the rear part, and the at least one intermediate part are comprised in a volume smaller than 450 $mm^3$ when they are nested with each other.

According to one embodiment, the front part, the rear part, and the at least one intermediate part are comprised, when they are nested with each other, in a parallelepiped having a lateral dimension comprised between 35 mm and 70 mm, a longitudinal dimension comprised between 75 mm and 150 mm, and a transverse dimension comprised between 75 mm and 150 mm.

The previously described arrangements allow folding the ice crampon when not in use. This allows having a very good compactness of the ice crampon in a folded position during transport or storage of the ice crampon. Furthermore, the weight of the entire ice crampon may be low.

According to one embodiment, the front part comprises a front platform intended to receive a front portion of the boot, and wherein the rear part comprises a rear platform intended to receive a rear portion of the boot, the front platform and the rear platform having a length along the longitudinal direction comprised between 3 cm and 6 cm, and in particular substantially equal to 4 cm.

According to one embodiment, the front part comprises a front fastener and the rear part comprises a rear fastener, at least one of the front fastener and the rear fastener comprises a lever configured to bear on a shoulder included on a portion of the boot and to longitudinally tension the at least one flexible link when the front and rear portions of the boot are fastened to the ice crampon respectively by means of the front fastener and the rear fastener of the ice crampon.

Advantageously, the presence of the intermediate part allows limiting the length of the front platform and of the rear platform while maintaining a gripping performance of the ice crampon on ice.

According to one embodiment, the rear part comprises a rear fastener configured to bear on a shoulder included on the rear portion of the boot.

According to one embodiment, the rear fastener is a wire exerting a pressure on the boot to avoid a relative play between the boot and the ice crampon.

According to one embodiment, the rear fastener comprises a lever configured to longitudinally tension the at least one flexible link when the front portion of the boot is fastened to the ice crampon by means of the front fastener.

According to one embodiment, the lever is configured to tension the rear fastener on the shoulder.

According to one embodiment, the ice crampon may comprise a stop strap, disposed for example at the lever, and configured to be attached around the boot.

According to one embodiment, the front part comprises a front fastener intended to fasten the front part with the front portion of the boot. For example, the front fastener can be configured to bear on a shoulder included on the front portion of the boot.

According to one embodiment, the front fastener is a wire exerting a pressure on the boot to prevent a relative play between the boot and the ice crampon.

According to one embodiment, the front fastener comprises a lever configured to longitudinally tension the at least one flexible link when the rear portion of the boot is fastened to the ice crampon by means of the rear fastener.

According to one embodiment, the lever is configured to tension the front fastener on the front shoulder of the boot.

According to one embodiment, the front fastener is rigid, and configured to automatically conform to the shape of the front portion of the boot.

According to another embodiment, the front fastener is semi-rigid, for example the front fastener can comprise an adjustable strap.

BRIEF DESCRIPTION OF THE DRAWINGS

Other aspects, aims, advantages and features of the disclosure will appear better upon reading the following detailed description of preferred embodiments thereof, given as a non-limiting example, and made with reference to the appended drawings wherein.

DETAILED DESCRIPTION OF THE DRAWINGS

Figure 1:
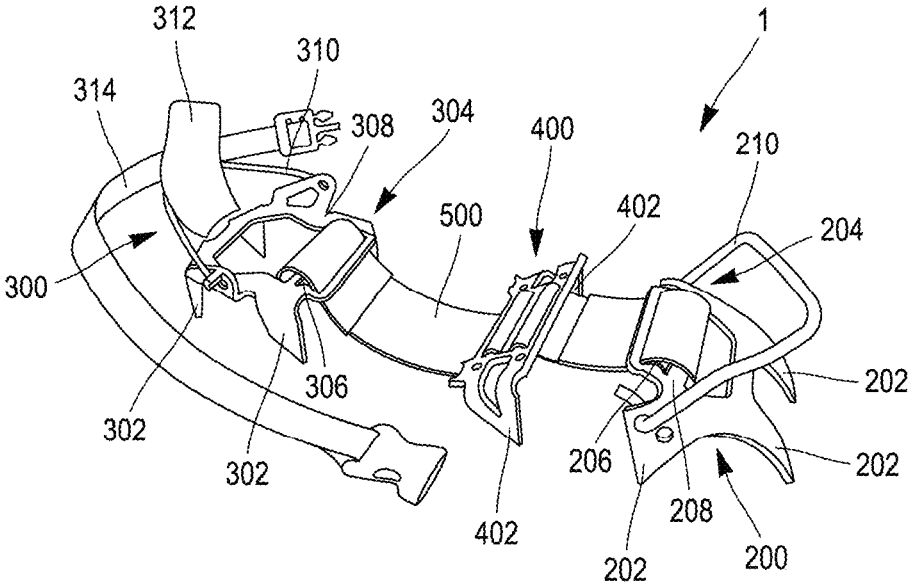
FIG. 1 is a schematic view of the ice crampon according to one embodiment of the disclosure.

In the figures and in the following description, the same reference numerals represent identical or similar elements. In addition, the different elements are not represented to scale in order to promote clarity of the figures. Furthermore, the different embodiments and variants do not exclude each other and may be combined together.

As illustrated in FIG. 1, the disclosure concerns an ice crampon 1 intended to be fastened to a boot.

The ice crampon 1 comprises a front part 200, a rear part 300, at least one intermediate part 400 and a flexible link 500.

The front part 200 comprises at least one pair of front spikes 202 offset from each other along a lateral direction of the front part 200.

According to one embodiment, the front part 200 comprises a front fastener 210 intended to fasten the front part 200 to the front portion of the boot.

For example, the front fastener 210 can be rigid, and configured to automatically conform to the shape of the front portion of the boot.

Alternatively, the front fastener 210 can be semi-rigid, for example the front fastener 210 can comprise a strap.

The rear part 300 comprises at least one pair of rear spikes 302 offset from each other along a lateral direction of the rear part.

Figure 2:
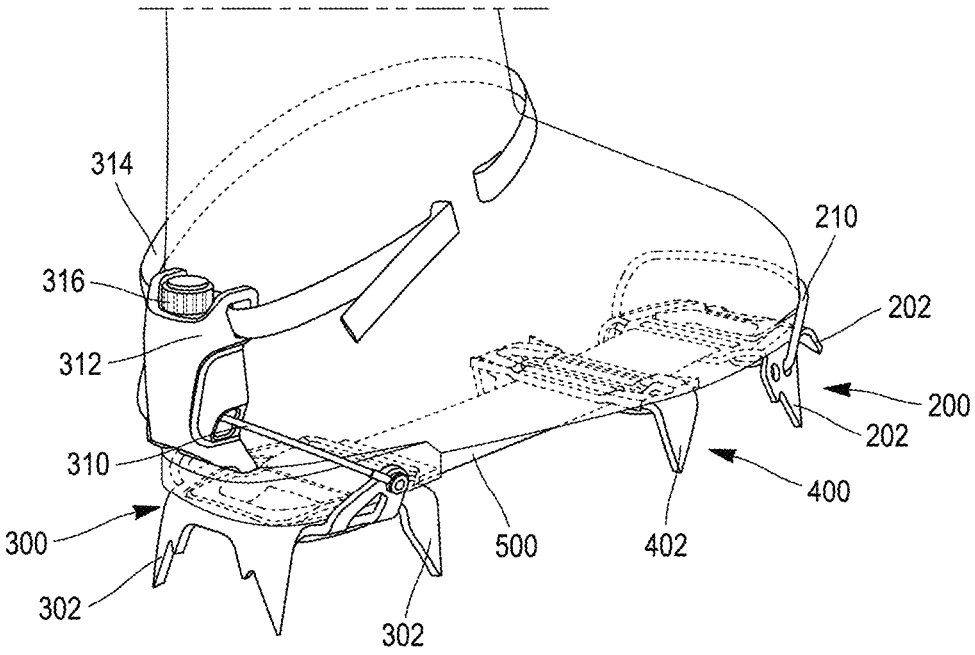
FIG. 2 is a schematic view of the ice crampon according to one embodiment of the disclosure when it is tensioned on a boot.

FIG. 1 presents an embodiment in which the rear part 300 comprises a rear fastener 310 configured to bear on a shoulder included on the rear portion of the boot. FIG. 2 illustrates a configuration in which the ice crampon 1 is fastened on said boot.

According to a non-limiting variant, the rear fastener 310 is a wire exerting a pressure on the boot to avoid a relative play between the boot and the ice crampon 1.

According to another non-limiting variant, the rear fastener 310 comprises a lever 312 configured to longitudinally tension the at least one flexible link 500 when the front portion of the boot is fastened to the ice crampon 1 by means of the front fastener 210. For example, the tensioning of the at least one flexible link 500 by the lever 310 can be carried out when the front fastener 210 comprises a rigid or semi-rigid stopper.

Advantageously, the lever 312 can comprise a micrometric adjustment system 316, for example a screw, configured to adjust the height of the lever 312 relative to a shoulder of the boot. In this way, the ice crampon 1 can be adapted to different boot types, or be adapted to a possible elongation of the flexible link 500, when the ice crampon 1 is tensioned on the boot.

Alternatively or jointly, the ice crampon 1 can comprise a stop strap 314, disposed for example at the lever 312, and configured to be attached around the boot.

According to one embodiment, the front part 200 comprises a front platform 208 intended to receive a front portion of the boot, and the rear part 300 can comprise a rear platform 308 intended to receive a rear portion of the boot.

According to this embodiment, the front platform 208 and the rear platform 308 may have a length along the longitudinal direction comprised between 3 cm and 6 cm, and in particular substantially equal to 4 cm.

As indicated above, the ice crampon also comprises at least one flexible link 500 which connects the front part 200 and the rear part 300 to each other along a longitudinal direction of the ice crampon 1. For example, the at least one flexible link 500 is made in one-piece extending integrally between the front part 200 and the rear part 300.

According to a non-limiting variant represented in FIG. 1, the front part 200 comprises a front connecting element 204 configured to connect the front part 200 with said at least one flexible link 500.

Figure 1A:
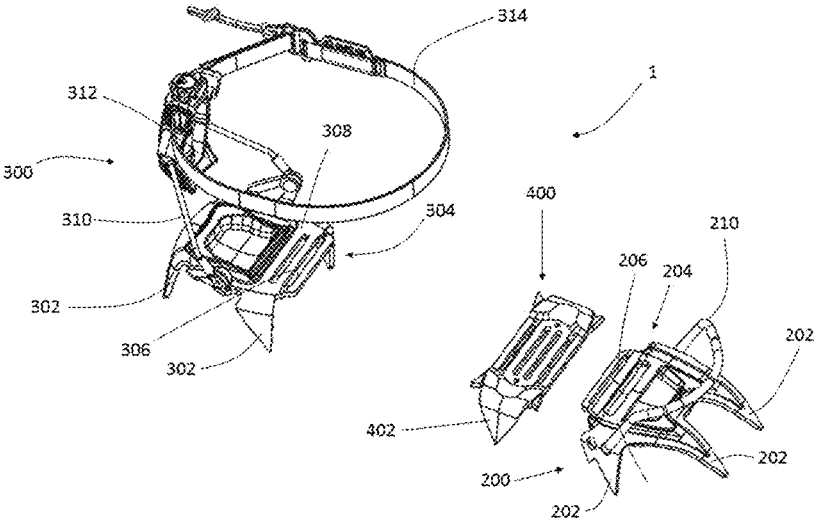
FIG. 1*a* is a schematic view of the ice crampon according to one embodiment of the invention, without the flexible link.

The front connecting element 204 may in particular comprise a front notch 206 on which the at least one flexible link 500 is inserted, the at least one flexible link 500 having a width smaller than the lateral dimension of the front notch 206 along the lateral direction of the front part 200. The front notch 206 and the lateral dimension of the front notch 206 is visible on FIG. 1*a*.

Alternatively or jointly, the rear part 300 may comprise a rear connecting element 304, configured to connect the rear part 300 with the flexible link 500.

The rear connecting element 304 may comprise a rear notch 306 on which the at least one flexible link 500 is inserted, the at least one flexible link 500 having a width smaller than the lateral dimension of the rear notch 306 along the lateral direction of the rear part 300. The rear notch 306 and the lateral dimension of the rear notch 306 is visible on FIG. 1*a*.

According to one embodiment, said at least one flexible link 500 is configured to be length-adjustable. Advantageously, the rear connecting element 304 and the front connecting element 204 can enable the length adjustment of said at least one flexible link 500.

According to one embodiment, the ice crampon 1 comprises a single flexible link 500 which has a width sufficient to ensure the stability of the ice crampon so that the front, intermediate and rear parts remain parallel to each other, in particular when the ice crampon 1 is longitudinally tensioned following a fastening on the boot. For example, the width of the flexible link can be greater than 3 cm counted perpendicular to the longitudinal direction of the ice crampon 1.

According to another embodiment, which is not represented, the ice crampon 1 comprises two flexible lateral links 500.

According to one embodiment, each flexible link 500 can consist of a piece of cable, a piece of strap or a piece of cord.

The ice crampon 1 also comprises at least one intermediate part 400 mounted on the flexible link 500 by being positioned between the front part 200 and the rear part 300. The at least one intermediate part 400 comprises at least one pair of intermediate spikes 402, these spikes being offset from each other along a lateral direction of the intermediate part 400.

Advantageously, the intermediate part 400 can be configured to be detachable from the flexible link 500 at the rear connecting element 304 or the front connecting element 204. In this way, it is possible to completely remove the intermediate part 400 from the ice crampon 1, for example to promote the compactness and the lightness of the ice crampon 1 to be adapted to the user's practice of the ice crampon 1.

Said at least one pair of front spikes 202, said at least one pair of rear spikes 302 and said at least one pair of intermediate spikes 402 are configured to prevent slipping of the ice crampon 1 on a ground, in particular an icy ground.

Furthermore, the front part 200, the rear part 300 and said at least one intermediate part 400 are hinged independently of each other at least along the longitudinal direction and along said lateral directions.

Finally, the position of the intermediate part 400 is adjustable relative to the flexible link 500 along the longitudinal direction. Advantageously, the at least one flexible link 500 can be configured to allow the intermediate part 400 to be positioned in abutment on the front part 200, or on the rear part 300.

As illustrated in the figures, the at least one flexible link 500 is configured to enable a continuous adjustment of the position of the intermediate part 400 relative to the flexible link 500 over the entire length of the flexible link 500. In particular, the adjustment of the intermediate part 400 on the flexible link 500 can be carried out by friction.

Furthermore, it may be provided that the at least one flexible link 500 is configured to enable a continuous adjustment of the position of the rear part 300 relative to the flexible link 500 over the entire length of the flexible link 500. In particular, the adjustment of the rear part 300 on the flexible link 500 can be carried out by friction.

The previously described arrangements allow the ice crampon 1 to be fastened to a boot.

According to one embodiment, the at least one flexible link 500 undergoes a longitudinal tension when the ice crampon 1 is fastened to the boot.

For example, the longitudinal tension is greater than 40 N, and more particularly greater than 50 N and in particular substantially equal to 60 N.

Advantageously, the longitudinal tension undergone by the flexible link 500 between the front part 200 and the rear part 300 provides a positive locking, for example by friction, of the longitudinal position of the intermediate part 400 along the flexible link 500.

According to one embodiment, the material of the at least one flexible link 500 has a rigidity such that the elongation of the flexible link is smaller than 15% when the ice crampon 1 is longitudinally tensioned.

For example, the material of the at least one flexible link 500 can comprise ultra-high molar mass polyethylene and/or high tenacity polyester guaranteeing an elongation smaller than 3%.

The presence of the intermediate part 400 allows in particular limiting the length of the front platform 208 and of the rear platform 308 while maintaining a gripping performance of the ice crampon 1 on ice.

When the ice crampon 1 is not fastened to the boot, the previously described arrangements, in particular the presence of the flexible link 500, allow individually hinging the front part 200, the rear part 300 and the at least one intermediate part 400.

Figure 3:
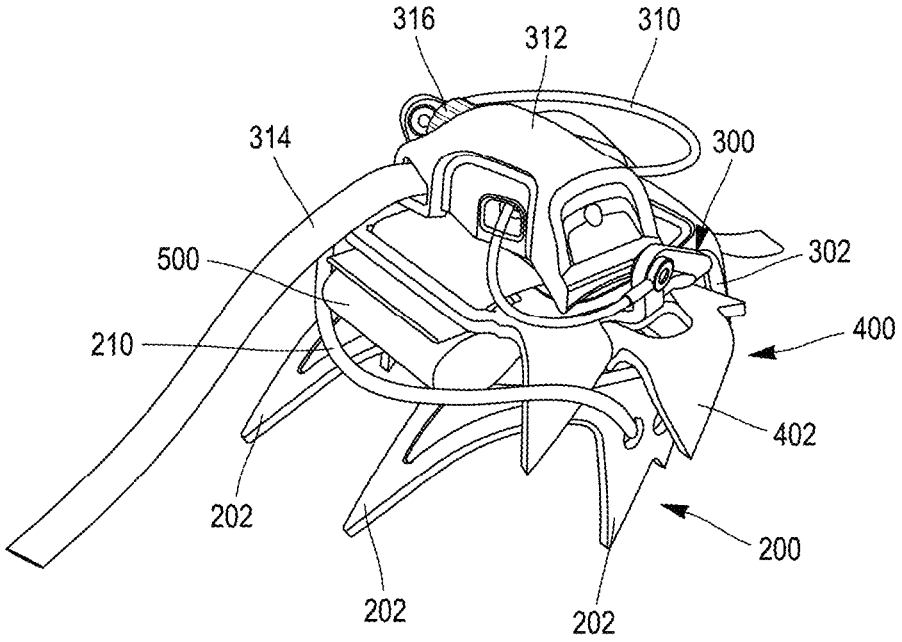
FIG. 3 is a schematic view of the ice crampon of FIG. 2 when it is folded over itself.

In this way, and as illustrated in FIG. 3, the front part 200, the rear part 300 and the at least one intermediate part 400 can be configured to be nested with each other when they are superimposed relative to each other in a transverse direction of the ice crampon 1.

For example, the front part 200, the rear part 300, and the at least one intermediate part 400 can be comprised in a volume smaller than 450 $mm^3$ when they are nested with each other.

Alternatively or jointly, the front part 200, the rear part 300, and the at least one intermediate part 400 can be comprised in a parallelepiped having a lateral dimension comprised between 35 mm and 70 mm, a longitudinal dimension comprised between 75 mm and 150 mm, and a transverse dimension comprised between 75 mm and 150 mm when nested with each other.

Thus, and advantageously, the at least one flexible link 500 is configured to allow the ice crampon 1 to vary between a deployed configuration in which the ice crampon 1 is able to be fastened to the boot, and a nested configuration in which the front part 200, the rear part 300 and the at least one intermediate part 400 are nested with each other. It is therefore well understood that the flexibility of the flexible link 500 allows the ice crampon 1 to fold over itself in particular to be stored when it is in the nested configuration.

According to one embodiment, the ice crampon 1 remains intact when it varies between the deployed configuration and the nested configuration. It is therefore well understood that it is not necessary to dismantle the ice crampon 1 so that it occupies the nested configuration.

Thus, the ice crampon 1 is able to be folded over itself when not in use. This allows increasing the compactness of the ice crampon 1 in a folded position during transport or storage of the ice crampon 1. Furthermore, the weight of the entire ice crampon 1 can be low.

Finally, and advantageously, the use of a flexible link 500 with a large width can improve the lateral hold of the ice crampon 1. In addition, the combination of a wide flexible link 500 with a rear part 300, an intermediate part 400, and a front part 200 having small dimensions allows guaranteeing a good stability of the boot on the ground and presenting an ice crampon 1 with limited bulk and reduced weight.

Furthermore, a wide flexible link 500 can facilitate the adjustment of the position of the intermediate part 400 along the flexible link 500 and the adjustment of the dimension between the front part 200 and the rear part 300.

By "wide", it should be understood a width of the flexible link 500 greater than one third of the width of the at least one intermediate part 400 counted in the lateral direction of the at least one intermediate part 400.

The previously described arrangements allow providing a lateral stability of the boot on the ice crampon 1, in particular by avoiding the relative rotation of the front part 200, of the rear part 300 and of the intermediate part 400 in particular when the ice crampon 1 is longitudinally tensioned. In other words, the previously described arrangements allow suppressing a lateral pivoting of the ice crampon 1.

The invention claimed is:

1. An ice crampon configured to be fastened to a boot, the ice crampon comprising:

a front part comprising at least one pair of front spikes offset from each other along a lateral direction of the front part;

a rear part comprising at least one pair of rear spikes offset from each other along a lateral direction of the rear part;

at least one flexible link which connects the front part and the rear part to each other along a longitudinal direction of the ice crampon; and at least one intermediate part mounted on the flexible link by being positioned between the front part and the rear part, the at least one intermediate part comprising at least one pair of intermediate spikes offset from each other along a lateral direction of the intermediate part;

said at least one pair of front spikes, said at least one pair of rear spikes and said at least one pair of intermediate spikes being configured to prevent slipping of the ice crampon on a ground and an icy ground;

the front part, the rear part and said at least one intermediate part being hinged independently of each other at least along the longitudinal direction and along said lateral directions, and the position of the intermediate part being adjustable relative to the flexible link along the longitudinal direction;

the at least one flexible link being configured to enable a continuous adjustment of the position of the intermediate part relative to the flexible link over the entire length of the flexible link.

2. The ice crampon according to claim 1, wherein the at least one flexible link is configured to be length-adjustable to adjust the distance separating the rear part and the front part.

3. The ice crampon according to claim 1, wherein the front part comprises a front connecting element configured to connect the front part with said at least one flexible link, and wherein the rear part comprises a rear connecting element, configured to connect the rear part with said at least one flexible link, the intermediate part being configured to be detachable from the flexible link at the rear connecting element or the front connecting element.

4. The ice crampon according to claim 3, wherein the front connecting element comprises a front notch on which the at least one flexible link is inserted, the at least one flexible link having a width smaller than a lateral dimension of the front notch along the lateral direction of the front part.

5. The ice crampon according to claim 3, wherein the rear connecting element comprises a rear notch on which the at least one flexible link is inserted, the at least one flexible link having a width smaller than a lateral dimension of the rear notch along the lateral direction of the rear part.

6. The ice crampon according to claim 1, comprising a single flexible link which has a width greater than 3 cm perpendicular to the longitudinal direction of the ice crampon.

7. The ice crampon according to claim 1, wherein the at least one flexible link undergoes longitudinal tension when the ice crampon is fastened to the boot.

8. The ice crampon according to claim 7, wherein the longitudinal tension undergone by the flexible link between the front part and the rear part ensures a friction locking of the longitudinal position of the intermediate part along the flexible link.

9. The ice crampon according to claim 1, wherein the material of the at least one flexible link has a rigidity such that the elongation of the flexible link is smaller than 15% when the ice crampon is longitudinally tensioned.

10. The ice crampon according to claim 1, wherein the front part, the rear part, and the at least one intermediate part are configured to nest with each other when they are superimposed relative to each other in a transverse direction of the ice crampon.

11. The ice crampon according to claim 10, wherein the front part, the rear part, and the at least one intermediate part are comprised in a volume smaller than 450 $mm^3$ when they are nested with each other.

12. The ice crampon according to claim 10, wherein the front part, the rear part, and the at least one intermediate part are comprised in a parallelepiped having a lateral dimension comprised between 35 mm and 70 mm, a longitudinal dimension comprised between 75 mm and 150 mm, and a transverse dimension comprised between 75 mm and 150 mm when they are nested with each other.

13. The ice crampon according to claim 1, wherein the front part comprises a front platform intended to receive a front portion of the boot, and wherein the rear part comprises a rear platform intended to receive a rear portion of the boot, the front platform and the rear platform each having a length along the longitudinal direction comprised between 3 cm and 6 cm.

14. The ice crampon according to claim 1, wherein the front part comprises a front fastener and wherein the rear part comprises a rear fastener, at least one of the front fastener and the rear fastener comprising a lever configured to bear on a shoulder included on a portion of the boot and to longitudinally tension the at least one flexible link when the front and rear portions of the boot are fastened to the ice crampon respectively by the front fastener and the rear fastener of the ice crampon.

15. The ice crampon according to claim 14, wherein the lever comprises a micrometric adjustment system configured to adjust the height of the lever relative to said shoulder of the boot.

* * * * *